US010787285B2

(12) United States Patent
Linnestad

(10) Patent No.: US 10,787,285 B2
(45) Date of Patent: Sep. 29, 2020

(54) APPARATUS AND METHOD FOR FILLING PRODUCT INTO CONTAINERS

(71) Applicant: ELOPAK AS, Spikkestad (NO)

(72) Inventor: Even Linnestad, Oslo (NO)

(73) Assignee: ELOPAK AS, Spikkestad (NO)

( * ) Notice: Subject to any disclaimer, the term of this patent is extended or adjusted under 35 U.S.C. 154(b) by 194 days.

(21) Appl. No.: 15/534,900

(22) PCT Filed: Dec. 2, 2015

(86) PCT No.: PCT/EP2015/078288

§ 371 (c)(1),
(2) Date: Jun. 9, 2017

(87) PCT Pub. No.: WO2016/091669

PCT Pub. Date: Jun. 16, 2016

(65) Prior Publication Data

US 2017/0327259 A1 Nov. 16, 2017

(30) Foreign Application Priority Data

Dec. 12, 2014 (DE) ..... 10 2014 118 526

(51) Int. Cl.
*B65B 55/10* (2006.01)
*B67C 7/00* (2006.01)
(Continued)

(52) U.S. Cl.
CPC ..... *B65B 55/10* (2013.01); *B65B 3/12* (2013.01); *B65B 39/06* (2013.01); *B65B 43/59* (2013.01);
(Continued)

(58) Field of Classification Search
CPC ..... B65B 55/10; B65B 57/145; B65B 43/59; B65B 3/12; B65B 39/06; B65B 55/00;
(Continued)

(56) References Cited

U.S. PATENT DOCUMENTS 2,771,645 A * 11/1956 Mck ..... B65B 55/10 422/304
4,208,852 A * 6/1980 Pioch ..... B29C 49/46 141/243
(Continued)

FOREIGN PATENT DOCUMENTS

DE 3323710 A1 1/1985
DE 102005004658 B3 6/2006
(Continued)

OTHER PUBLICATIONS

International Searching Authority, Written Opinion in corresponding International Application, dated Feb. 10, 2016, 5 pgs.

*Primary Examiner* — Matthew W Jellett
(74) *Attorney, Agent, or Firm* — Lucas & Mercanti, LLP

(57) ABSTRACT

An apparatus for filling product into containers includes a working chamber through which the containers pass and the containers are acted upon by a sterile fluid to avoid contamination. An external line extends through the working chamber having a plurality of gas openings for the introduction of sterile air into the working chamber and that an internal line extends into the external line having a plurality of openings for spraying a cleaning medium. An annular chamber extends in a longitudinal direction between the internal and the external line. The cross-sectional area of the annular chamber varies in the longitudinal direction so that an even distribution of sterile air emerging from the gas openings into the working chamber is achieved.

19 Claims, 3 Drawing Sheets

(51) Int. Cl.

| | |
|---|---|
| ***B65B 3/12*** | (2006.01) |
| ***B65B 39/06*** | (2006.01) |
| ***B65B 43/59*** | (2006.01) |
| ***B65B 57/14*** | (2006.01) |
| *B67C 3/22* | (2006.01) |
| *B65B 55/00* | (2006.01) |

(52) U.S. Cl.
CPC ..... *B65B 57/145* (2013.01); *B67C 7/00* (2013.01); *B67C 7/0086* (2013.01); *B65B 55/00* (2013.01); *B65B 2210/06* (2013.01); *B67C 2003/228* (2013.01); *Y10T 137/0419* (2015.04); *Y10T 137/0424* (2015.04); *Y10T 137/85938* (2015.04)

(58) Field of Classification Search
CPC ..... B65B 2210/06; B67C 7/00; B67C 7/0086; B67C 2003/228; Y10T 137/85938; Y10T 137/0419; Y10T 137/0424
USPC ..... 138/26, 44
See application file for complete search history.

(56) References Cited

U.S. PATENT DOCUMENTS

| | | | | |
|---|---|---|---|---|
| 4,922,958 | A * | 5/1990 | Lemp | F02M 69/465 123/456 |
| 5,029,598 | A * | 7/1991 | Stroszynski | C23C 16/455 137/1 |
| 5,127,416 | A * | 7/1992 | Wakabayashi | B65B 55/025 134/104.1 |
| 8,944,079 | B2 | 2/2015 | Auer | |

FOREIGN PATENT DOCUMENTS

| | | | |
|---|---|---|---|
| EP | 0374586 | A1 | 6/1990 |
| EP | 0427348 | A1 | 5/1991 |
| WO | 2010145978 | A2 | 12/2010 |

* cited by examiner

A)

B)

C)

APPARATUS AND METHOD FOR FILLING PRODUCT INTO CONTAINERS

CROSS-REFERENCE TO RELATED APPLICATIONS

This application is a 371 of PCT/EP2015/078288 filed Dec. 2, 2015, which in turn claims the priority of DE 10 2014 118 526.9 filed Dec. 12, 2014, the priority of both applications is hereby claimed and both applications are incorporated herein by reference.

BACKGROUND OF THE INVENTION

The invention relates to an apparatus and a method for filling product, in particular liquid foodstuffs, into containers. Whilst the containers pass through a working chamber of the apparatus from an inlet to an outlet side, the containers passing through the working chamber are acted upon by a sterile fluid, in particular sterile air, in order to avoid contamination. It is necessary to maintain the sterile atmosphere in the working chamber until the containers inside the working chamber are closed.

When filling liquid foodstuffs into containers, it has proved expedient to divide the working chamber starting from the inlet side into a sterilizing region and a filling region. The sterilizing region starting from the inlet side comprises a pre-heating zone, a sterilization zone and a drying zone. The adjoining filling region comprises a filling zone and a closure zone. In the pre-heating zone the containers are heated with hot air. The containers then enter into the sterilization zone where both the outer and the inner surfaces of the containers are acted upon with a sterilizing agent, preferably with hydrogen peroxide ($H_2O_2$). In order to remove the hydrogen peroxide again after the sterilization, the containers then enter into the drying zone where the containers are flushed with hot air. Then the actual filling of the liquid foodstuffs into the containers treated in such a manner takes place in the filling zone. Finally the filled container enters into the closing zone in which the containers which have been open up till then are closed; this is accomplished, for example, by folding in the top flaps which are then heated and pressed by means of sealing tools in the region of the gable. Located between the filling region and the sterilizing region is a separation wall running transversely to the conveying path of the containers through the working chamber which at least has passages for the containers conveyed by a transport means along the conveying path and the lines for introducing the sterile fluid.

After completion of the filling and conveying of a large number of containers through the working chamber, the working chamber is cleaned. In particular, water, alkali- or acid-based cleaning products and hydrogen peroxide ($H_2O_2$) aerosols are considered as cleaning media for the working chamber.

Known from WO 2010/145978 A2 is a generic apparatus and a generic method for filling product, in particular liquid foodstuffs, in which the expenditure on cleaning of lines for introducing sterile fluid into the working chamber is reduced considerably. The sterile fluid is introduced into the working chamber by means of an external line having a plurality of openings extending through the working chamber. In order to distribute the sterile fluid in the working chamber of the apparatus uniformly over the containers, at least one profile having openings extending over the containers is disposed underneath the external line in the working chamber, which distributes the sterile fluid introduced by the external line over the containers. An internal line having a plurality of nozzles for spraying the cleaning medium extends into the external line. The external line surrounding the internal line is automatically cleaned after completion of the filling during the cleaning operation of the working chamber when the cleaning medium emerging from the nozzles of the internal line under pressure impinges upon the inner surface of the external line. Preferably the external and the internal line are disposed so that they can be rotated relative to one another about their longitudinal axes in order to ensure a complete cleaning of the inner surface of the external line and the working chamber.

During operation of the known apparatus it has been found that unsterile hot air from the sterilizing region, in particular the pre-heating zone and the sterilization zone, can flow back into the external line for the sterile fluid and can thereby adversely affect the sterile atmosphere in the filling zone. An ejector effect which occurs at various places of the external line is responsible for the backflow.

In addition, the mass flow of the sterile fluid emerging from the openings of the external line and the flow distribution of the sterile fluid in the working chamber are not suitable under all operating conditions to ensure that the sterile atmosphere in the working chamber is maintained.

Finally a considerable noise pollution occurs during introduction of the sterile fluid into the working chamber.

BRIEF SUMMARY OF THE PRESENT INVENTION

Starting from WO 2010/145978 A2 as closest prior art, it is an object of the invention to provide a generic apparatus in which the sterile atmosphere in the working chamber, in particular in the filling region, is improved. In addition, a method for improving the sterile atmosphere in the working chamber is to be provided.

The cross-sectional area of the annular chamber varies in the longitudinal direction at least in sections such that a substantially constant pressure distribution along the length of the outer line and thereby an even distribution of sterile fluid emerging from the openings in the outer line into the working chamber is achieved. The invention purposefully manipulates the pressure and the flow velocity of the sterile fluid in the annular chamber by the sectional variation of the cross-sectional area of the annular chamber. This is arranged in a manner that balances the cross-sectional area with the desired decrease in mass flow in the annular chamber to ensure constant axial velocity, and therefore also constant static pressure, in the annular chamber. By gradually reducing the cross-sectional area down to practically zero at the end of the annular chamber a constant static pressure without significant build up of a stagnation pressure is achieved in the entire length of the annular chamber.

In order to achieve a uniform static pressure distribution and a uniform flow velocity of the sterile fluid in the particularly critical filling region, it is advantageous if the cross-section of the annular chamber varies over the entire length of the filling region in the longitudinal direction. In experiments it has been found that the best effects are achieved by a linear cross-sectional variation of the annular chamber.

For constructive reasons, the cross-section of the external line is constant over the entire length of the working chamber. Insofar as the cross-section is circular, a linear variation of the cross-sectional area of the annular chamber can be achieved by an internal line, which has a gradually increasing diameter at least in sections. A linear variation of the cross sectional area as mentioned above should in the present invention also be understood as having a lateral surface configured to linearly vary the cross-sectional area of the annular chamber.

If the external line has a uniform cross-section in the longitudinal direction the cross-sectional area of the annular chamber in the flow direction can be reduced linearly in a particularly simple manner whereby the cross-sectional area of the internal line increases linearly in the longitudinal direction. The following relationship is obtained for an external and an internal line having a circular cross-section:

Allowing the internal line diameter $d_{clean}$ to vary to obtain a linear reduction of cross section area one gets the following expressions for the cross section area $A_{cross}$ of the annular chamber between the internal and external line with diameter $d_{Hepa}$ along the length x of the lines:

$$A_{cross}(x) = ax + b, \text{ and} \quad \text{I}$$

$$A_{cross}(x) = \frac{\pi}{4} \cdot (d_{HEPA}^2 - d_{clean}(x)^2) \quad \text{II}$$

If the diameter increase of the internal line starts at the centre of the first opening (cleaning nozzle) and we define x=0 at this point, the cross section is, according to equation I:

$$A_{cross}(0) = \frac{\pi}{4}(d_{HEPA}^2 - d(0)_{clean}^2) \text{ and,}$$

$$A_{cross}(L_{clean}) = 0$$

Hence, the constants in equation I are:

$$b = \frac{\pi}{4}(d_{HEPA}^2 - d(0)_{clean}^2) \text{ and,}$$

$$a = -\frac{\frac{\pi}{4}(d_{HEPA}^2 - d(0)_{clean}^2)}{L_{clean}}$$

and equation I becomes:

$$A(x) = \frac{\pi}{4}(d_{HEPA}^2 - d(0)_{clean}^2) \cdot \left[1 - \frac{x}{L_{clean}}\right]$$

Combining equation I and II:

$$A_{cross}(x) = \frac{\pi}{4} \cdot (d_{HEPA}^2 - d_{clean}(x)^2)$$

$$\frac{\pi}{4} \cdot (d_{HEPA}^2 - d_{clean}(x)^2) = \frac{\pi}{4}(d_{HEPA}^2 - d(0)_{clean}^2) \cdot \left[\frac{x}{L_{clean}} + 1\right],$$

solving for $d_{clean}(x)$ $$d_{clean}(x) = \sqrt{d_{HEPA}^2 - (d_{HEPA}^2 - d(0)_{clean}^2) \cdot \left[1 - \frac{x}{L_{clean}}\right]} \quad \text{III}$$

In other words the diameter of the inner line (cleaning pipe) shall be a square root function of the distance x from the first opening in the inner line.

If the external line and the internal line can be rotated relative to one another about their longitudinal axes, the internal cleaning of the external line can be further improved over its entire circumference.

In order to distribute the sterile fluid, in particular the sterile air, in the working chamber of the apparatus in two stages over the containers, in one embodiment of the invention it is proposed that at least one profile having openings extending over the containers is disposed underneath the external line in the working chamber, which distributes the sterile fluid introduced by the external line over the containers. In particular rectangular profiles or angled profiles are considered as profile types.

The rectangular profiles have a small height compared to width. They are hereinafter also designated as (perforated) plates.

In order to enable an in particular all-round cleaning of the profile(s) with the cleaning medium, in an advantageous embodiment of the invention each profile is disposed rotatably about an axis, about which the profile can be rotated between a first position in which the containers are present in the working chamber and a second position in which no containers are present in the working chamber. The cleaning medium is applied in the second position of the profile.

In order to increase the static pressure of the sterile fluid in the annular chamber, in one embodiment of the invention it is provided that the internal line within the external line can be rotated into at least one closed position in which at least one closure element closes the openings in the internal line with respect to the annular chamber. Irrespective of this feature the internal line is disconnected from the supply for the cleaning medium during the introduction of the sterile fluid into the working chamber.

The increase in the static pressure reduces the ejector effect and therefore the risk of back-flow of unsterile air into the external line for the sterile fluid.

A back-flow of unsterile air into the external line for the sterile fluid can also be prevented whilst the external line upstream of the filling region has no openings for the introduction of a sterile fluid into the working chamber, preferably over the entire length of the sterilizing region. At the same time, the absence of openings in the sterilizing region has the effect that the noise pollution is reduced during introduction of the sterile fluid into the working chamber.

To ensure as vertical as possible laminar flow of the sterile fluid within the working chamber, the static pressure of the sterile fluid in the working chamber must be substantially higher than the dynamic pressure. If the static pressure is substantially higher than the kinematic pressure, an undesirable backflow of the sterile fluid through the plates can be significantly reduced.

Nevertheless in experiments it has been found that at various locations in the filling region of the working chamber in some cases too-low static pressures and relatively high local flow velocities of the sterile fluid can be present. A location upstream of the filling station within the filling region is the most problematical. As a result of the too-low static pressure, back-flows can occur through the perforated plates. In order to avoid back-flows, turbulence and a non-uniform flow distribution of the sterile fluid in the sterilizing region of the working chamber, in one embodiment of the invention at least one flow body is disposed between the separation wall and the filling station in the filling region, which offers a flow resistance to the sterile fluid emerging from the openings of the external line. The flow body is, for example, a wall which fills the free cross-section of the working chamber in the filling region above the profile when this is located in the first position.

BRIEF DESCRIPTION OF THE DRAWINGS

The invention is explained in greater detail below on the basis of the figures.

DETAILED DESCRIPTION OF THE PREFERRED EMBODIMENTS

Figure 1:
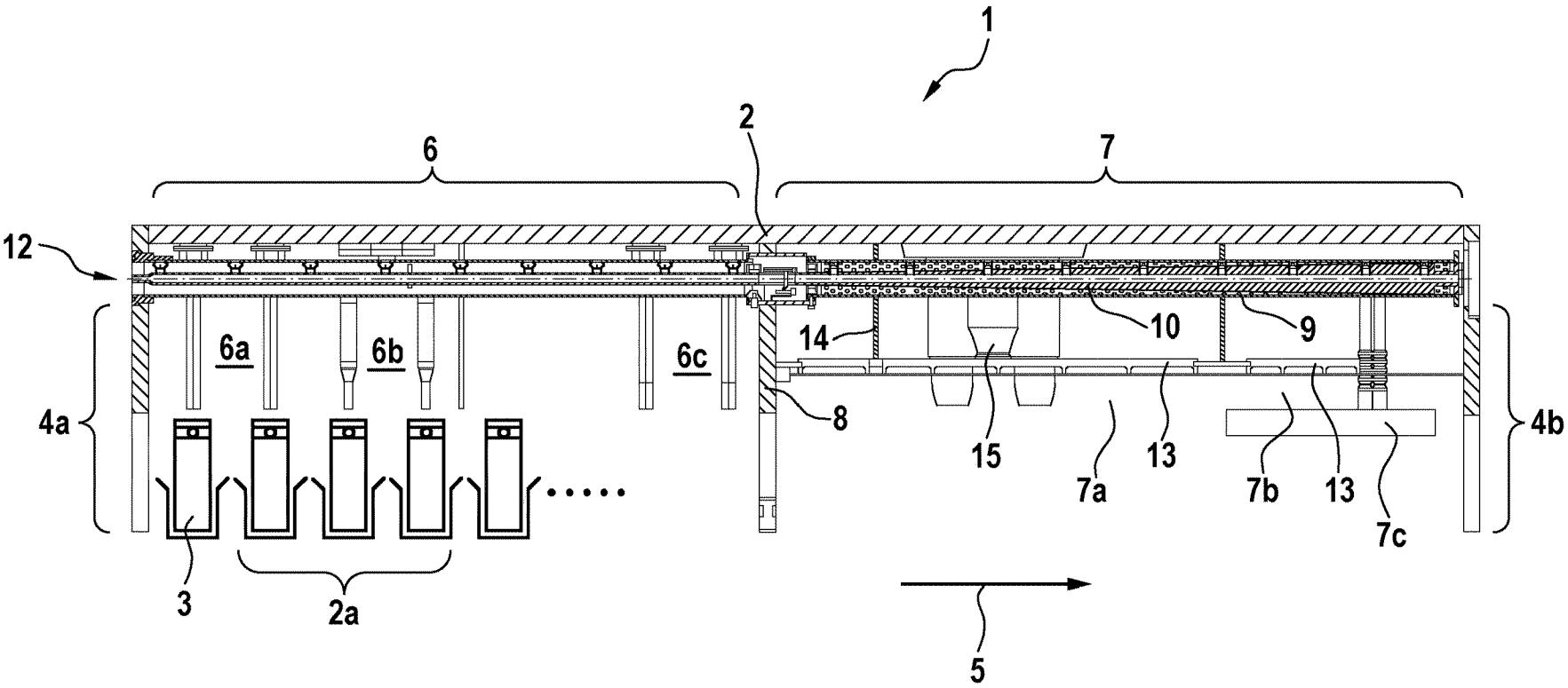
FIG. 1 shows a schematic partial longitudinal cross section through a filling machine.

The filling machine 1 comprises a sterile working chamber 2, having the form of a hollow substantially rectangular block.

Containers 3 designed to hold beverages are conveyed from an inlet side 4*a* to an outlet side 4*b* of the working chamber 2 along at least one conveying path in a longitudinal direction 5 of the working chamber 2 by means of an endless conveyor 2*a*.

Proceeding from the inlet side 4*a*, the working chamber 2 is divided along the length of the working chamber into a sterilizing region 6 and a filling region 7. The sterilizing region 6 is separated from the filling region 7 by a separation wall 8 extending transversely to the longitudinal direction 5.

The sterilizing region 6 starting from the inlet side 4*a* comprises a pre-heating zone 6*a*, a sterilization zone 6*b* and a drying zone 6*c*. The adjoining filling region 7 comprises a filling zone 7*a* and a closure zone 7*b*. The filling of the liquid foodstuffs into the containers 3 pre-treated in the sterilizing region 6 takes place in the filling zone 7*a* by means of a filling station 15. The filled containers 3, which have been open until now, subsequently enter into the closing zone 7*b* in which the containers 3 are closed.

Feed elements for hot air, hydrogen peroxide and optionally for a process gas such as nitrogen dioxide to prevent oxidation of the beverage project from the ceiling of the working chamber 2 into the different zones 6 *a, b, c* of the sterilizing region 6.

At least one external line 9 configured as a gas distribution pipe for sterile air is arranged under the ceiling of the working chamber 2 concentric to the longitudinal axis of an internal line 10 configured as a spray pipe for a cleaning medium. The external line 9 and the internal line 10 extend through the entire working chamber 2 from the inlet side 4*a* to the outlet side 4*b*. In a vertical projection the external line 9 is located offset to the left or right of the conveying path of the containers 3.

Each external line 9 has a plurality of gas openings 9*a*, which are distributed uniformly over the section of the external line 9 extending through the filling region 7 and also uniformly around its circumference. On a line parallel to the longitudinal axis of the external line 9 extending through the sterilizing and filling region 6,7, some openings 9*b* are present which are larger than the gas openings 9*a*. On a line parallel to the longitudinal axis of each internal line 10, several cleaning medium openings 10*a* of fan jet nozzles are arranged on the lateral surface of the external line 10. The size and contour of the cleaning medium openings 10*a* agree approximately with the size and contour of the openings 9*b* in the external line 9.

An annular chamber 11 extends in the longitudinal direction 5 between the internal line 10 and the external line 9 having a closed end 11*a* at the outlet side 4*b* of the working chamber 2.

An inlet 12 for supplying sterile air into the annular chamber 11 is arranged on the opposite end of the annular chamber whereby a flow direction of the sterile air starting from the inlet 12 towards the closed end 11*a* of the annular chamber 11 is defined.

On one side 10*b*, the internal line 10 is sealed off at its end. On the opposite side, the internal line is connected to a supply for the cleaning medium to the interior of the internal line 10.

The external line 9 and the internal line 10 are able to rotate independently of each other around their longitudinal axes by means of a drive, installed at one end outside the working chamber 2.

Below the external line 9 and above a filling plane for the containers 3 profiles 13, configured as flat perforated plates are mounted on a driven shaft. These perforated plates can be rotated out of the horizontal operating position shown in FIG. 1 into a cleaning position and vice versa. The whole-area coverage by the perforated plates in the filling region 7 when in their operating position has the result of optimally distributing the sterile air supplied through the external line 9 in the filling plane located underneath the perforated plates.

Figure 2:
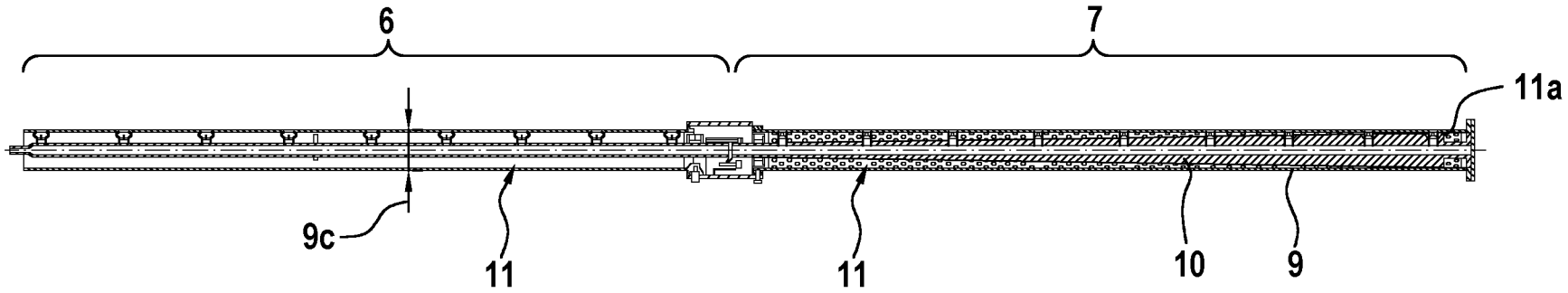
FIG. 2A) shows an enlarged cross section through an internal line and an external line extending through the filling machine shown in FIG. 1.
FIG. 2B) shows an enlarged partial cross section through the internal line and the external line extending through a sterilizing region of the filling machine shown in FIG. 1.
FIG. 2C) shows an enlarged partial cross section through the internal line and the external line extending through a filling region of the filling machine shown in FIG. 1.
Figure 2:
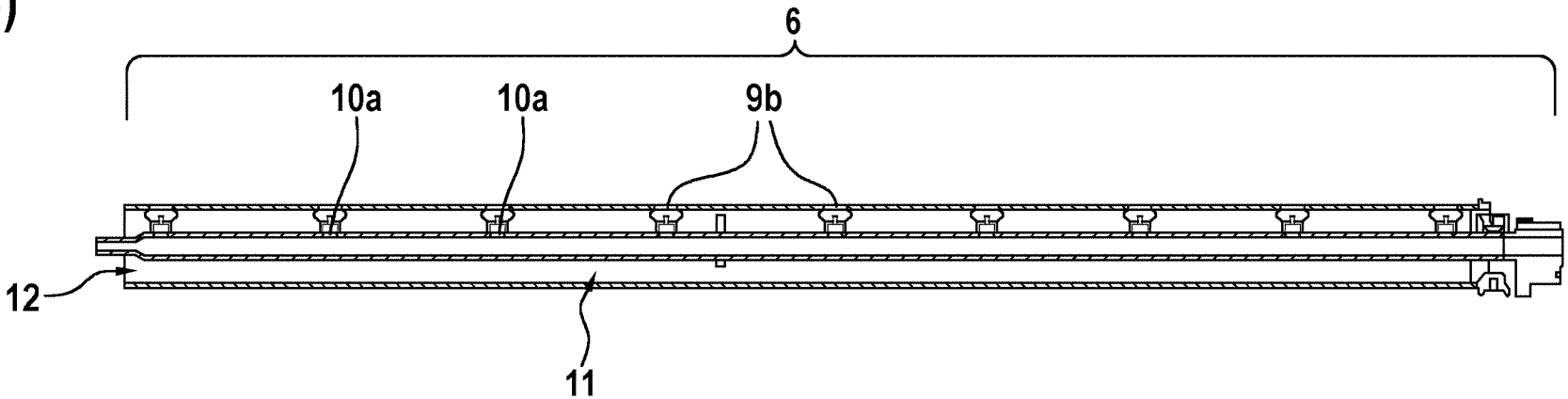
Figure 2:
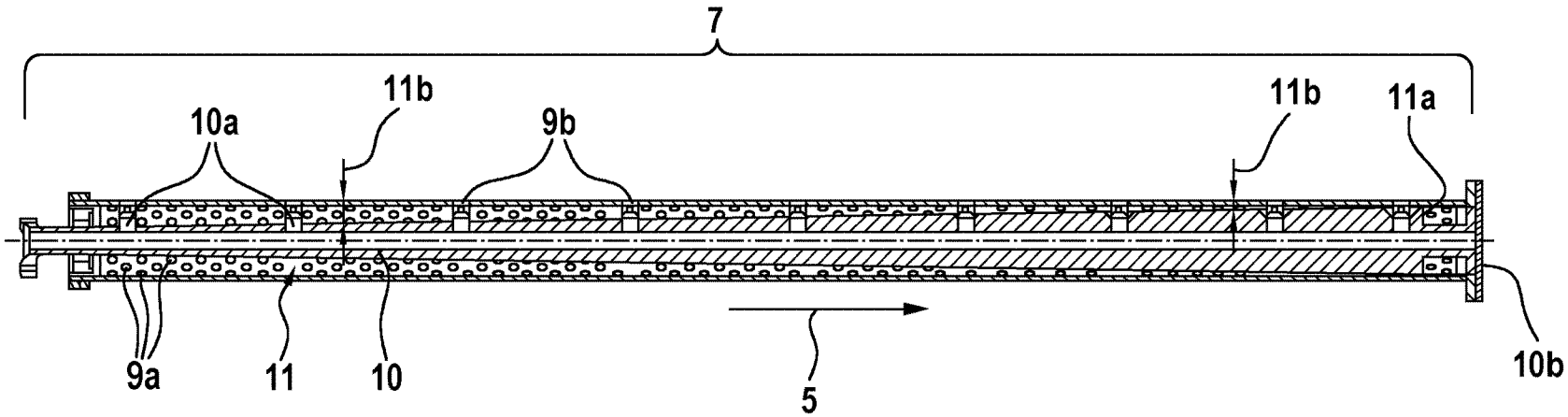

In order to achieve an even distribution of sterile air, a uniform pressure distribution and a uniform flow velocity of the sterile fluid in the particularly critical filling region 7, the cross-section area 11*b* of the annular chamber 11 varies substantially over the entire length of the filling region 7 in the longitudinal direction 5. As best shown in FIG. 2 *c* the cross-sectional area 11*b* of the annular chamber 11 decreases linearly in the flow direction towards the closed end 11*a* of the annular chamber 11. The reduction of the cross-sectional area 11*b* counteracts the increase in the static pressure towards the closed end 11*a* of the annular chamber 11. Simultaneously the flow velocity is becoming more even.

For construction reasons the circular cross-section 9*c* of the external line 9 configured as a pipe is uniform over the entire length of the working chamber 2. The linear variation of the cross-sectional area 11*b* of the annular chamber 11 is achieved by the internal line 10 configured as a pipe which diameter increases substantially over the entire length of the filling region 7.

Under certain operation conditions the sterile air emerging from the gas openings 9*a* in the external line 9 still may have a high flow velocity in the longitudinal direction 5 of the working chamber 2, resulting in turbulence in the working chamber 2 and an area within the filling region 7 behind the separation wall 8 with a too low static pressure. This too low static pressure may cause a back-flow of the sterile air through the perforated plates 13. In order to avoid turbulence and locally a too low static pressure in one embodiment of the invention a flow body 14 is disposed between the separation wall 8 and the filling station 15 in the filling region 7, which offers a flow resistance to the sterile fluid emerging from the openings 9*a* of the external line 9. The said flow body 14 is an additional wall arranged in a parallel distance from the separation wall 8 filling the free cross-section of the working chamber 2 in the filling region 7 above the perforated plate 13 when this is located in the horizontal working position as shown in FIG. 1. This additional wall creates an additional chamber within the filling zone 7*a* limiting the flow of sterile air in this zone and thereby reducing turbulence and increasing the static pressure.

Additionally under such operation conditions it may be advisable to limit the spill-over of sterile air from the sterilization region 6 to the filling region 7 by providing sealing elements which more fully close the separation wall 8 between the two regions 6,7.

The filling machine operates during the filling of containers 3 with beverages and during the following cleaning process with a cleaning medium as follows:

A conveyor 2*a* conveys a plurality of containers 3 simultaneously into the preheating zone 6*a* first, in which all of the containers 3 are treated simultaneously with the hot air. Then the containers 3, thus heated with hot air, advance to the sterilization zone 6*b*, where they are treated with hydrogen peroxide. In the next step of the process, the containers 3 are sent to the drying zone 6*c*, where the hydrogen peroxide is dried off with air. The sterilized containers 3 leaving the sterilizing region 6 now advance to the filling zone 7*a*, where they are filled with beverages simultaneously through feed elements of the filling station 15, before the top flaps, which are oriented parallel to the conveying path are mechanically closed by guide profiles in the following closure zone 7*b* and then heated and pressed together by sealing tools 7*c*. Finally, the now sealed containers 3 leave the working chamber 2 at the outlet side 4*b*.

In order to maintain a clean-room atmosphere in the working chamber 2 until the containers 3 have been sealed in the closure zone 7*b*, sterile air, which flows out into the working chamber 2 through the gas openings 9*a*, is supplied continuously through the external line 9. The external line 9 configured as a pipe with uniform circular cross-section 9*c* together with the internal line 10 configured as a pipe which diameter increases substantially over the entire length of the filling region providing a constant pressure distribution and an even distribution of the sterile air emerging from the gas openings 9*a* within the filling region 7*a*.

After completion of the filling and conveying of a large number of containers 3 through the working chamber 2, the filling machine 1 must be cleaned completely before the next filling operation. For this purpose, the internal line 10 is supplied with cleaning medium, which emerges through the cleaning medium openings 10*a* arranged in a straight line. During the cleaning process the internal line 10 rotates around its longitudinal axis. The larger openings 9*b* in the external line 9 are aligned with cleaning medium openings 10*a* of the fan jet nozzles of the internal line 10 to ensure the unhindered outflow of the cleaning medium during the cleaning operation. The external line 9 rotates synchronously with the internal line 10 in the same direction, so that the cleaning medium openings 10*a* remain aligned with the larger openings 9*b* during the entire cleaning operation.

Finally the rotation of the external line 9 is stopped and/or its rotational direction reversed to ensure that the cleaning medium emerging from the cleaning medium openings 10*a* is distributed over the entire inside surface of the external line 9.

So that the areas underneath the perforated plates 13 can also be cleaned effectively during the cleaning of the working chamber 2, the perforated plates are pivoted into a vertical cleaning position during the cleaning operation. To clean the perforated plates 13 themselves on all sides, these plates 13 are pivoted 360 degrees at least once, preferably several times, so that all surfaces of the perforated plates 13 are exposed at least once directly to the cleaning medium emerging from the cleaning medium openings 10*a*.

The invention claimed is:

1. An apparatus, comprising:

a working chamber through which containers are conveyed in a longitudinal direction of the working chamber from an inlet side to an outlet side, the working chamber being divided in the longitudinal direction into a sterilizing region proximate the inlet side and a filling region distal from the inlet side;

at least one station in the working chamber which executes a working step on the containers;

an external line configured as a gas distribution pipe extending through the working chamber and having a plurality of openings for introducing a sterile fluid into the working chamber to create a sterile atmosphere in the working chamber, the external line having an inner diameter that is constant;

an internal line configured as a spray pipe extending into the external line and having a plurality of openings for spraying a cleaning medium, the internal line having an inlet end and a closed end;

an annular chamber having a closed end, extending in the longitudinal direction, and being defined between an outer diameter of the internal line and the inner diameter of the external line; and an inlet for supplying the sterile fluid into the annual chamber, the inlet predefining a flow direction in the annular chamber for the sterile fluid starting from the inlet toward the closed end of the annular chamber, wherein the outer diameter of the internal line increases in the flow direction of the annular chamber such that a cross-section of the annular chamber in a direction perpendicular to the longitudinal direction has a cross-sectional area that decreases linearly in the flow direction of the annular chamber over an entire length of the filling region.

2. The apparatus according to claim 1, wherein the sterilizing region being separated from the filling region by a separation wall extending transversely to the longitudinal direction, and the at least one station comprises a filling station for filling the containers with a product, the filling station disposed in the filling region.

3. The apparatus according to claim 2, wherein a cross-section of the external line is constant over an entire length of the working chamber.

4. The apparatus according to claim 3, wherein a cross-section of the internal line increases substantially over the entire length of the filling region in the longitudinal direction.

5. The apparatus according to claim 1, wherein the external line and the internal line are rotatable relative to one another about longitudinal axes thereof.

6. The apparatus according to claim 1, further comprising at least one profile provided with openings extending over the containers disposed in the working chamber, the at least one profile distributing the sterile fluid introduced by the external line over the containers.

7. The apparatus according to claim 6, wherein each the at least one profile is rotatable about an axis between a first operating position, when containers are present in the working chamber, and a second cleaning position, when no containers are present in the working chamber.

8. The apparatus according to claim 5, wherein the internal line is rotatable in the external line to at least one closed position in which at least one closure element closes the openings in the inner line with respect to the annular chamber.

9. The apparatus according to claim 2, wherein the external line in the flow direction upstream of the filling region has no openings for the introduction of a sterile fluid into the working chamber.

10. The apparatus according to claim 2, further comprising at least one flow body disposed in the filling region configured to provide a flow resistance to the sterile fluid emerging from the openings of the external line.

11. The apparatus according to claim 10, further comprising at least one profile provided with openings extending over the containers disposed in the working chamber, which distributes the sterile fluid introduced by the external line over the containers, wherein the at least one profile is rotatable about an axis between a first operating position and a second cleaning position, each the at least one flow body filling the free cross-section of the working chamber in the filling region above each the at least one profile, when the at least one profile is located in the first operating position.

12. The apparatus according to claim 10, wherein the at least one flow body is disposed in the flow direction upstream of the filling station in the filling region.

13. A method comprising the steps of:

introducing a sterile fluid into a working chamber using an external line configured as a gas distribution pipe having a plurality of openings and extending through the working chamber, the external line having an internal diameter that is constant, the working chamber having an inlet side and an outlet side and being divided in the longitudinal direction into a sterilizing region proximate the inlet side and a filling region distal from the inlet side;

conveying containers in a longitudinal direction through the working chamber;

performing at least one working step on the containers in a sterile atmosphere;

introducing a cleaning medium through an internal line configured as a spray pipe having a plurality of openings, the internal line extending into the external line and having an inlet and an outlet, and spraying the cleaning medium into an annular chamber which extends in the longitudinal direction between an outer diameter of the internal line and an inner diameter of the external line; and supplying the sterile fluid in a flow direction in the annular chamber, the outer diameter of the internal line increasing in the flow direction of the annular chamber such that a cross-section of the annular chamber in a direction perpendicular to the longitudinal direction has a cross-sectional area that decreases linearly in the flow direction of the annular chamber over an entire length of the filling region.

14. The method according to claim 13, wherein the working chamber is divided by a separation wall into the sterilizing region and the filling region, the step of performing at least one working step includes filling the containers in the filling region, and the step of supplying the sterile fluid is performed in a flow direction in the annular chamber.

15. The method according to claim 13, wherein the internal line and the external line are rotated at least temporarily relative to one another about longitudinal axes thereof during the step of introducing the cleaning medium through the internal line.

16. The method according to claim 13, wherein the sterile fluid introduced by the external line is distributed over the containers in the working chamber by at least one profile with openings.

17. The method according to claim 16, wherein the at least one profile is rotated from a first position, in which sterile fluid is introduced into the working chamber, to a second position, in which the cleaning medium is applied.

18. The method according to claim 13, wherein the openings in the internal line are closed during the step of introducing of the sterile fluid into the working chamber.

19. The method according to claim 13, wherein a flow resistance to the sterile fluid introduced in the filling region of the working chamber is provided by a flow body during the step of introducing the sterile fluid.

* * * * *